US007735957B2

(12) United States Patent
Kudo et al.

(10) Patent No.: US 7,735,957 B2
(45) Date of Patent: Jun. 15, 2010

(54) SUCTION RECOVERY METHOD OF INK JET PRINTING APPARATUS AND INK JET PRINTING APPARATUS

(75) Inventors: Satoshi Kudo, Sagamihara (JP); Yukuo Yamaguchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 672 days.

(21) Appl. No.: 11/735,079

(22) Filed: Apr. 13, 2007

(65) Prior Publication Data

US 2007/0252866 A1 Nov. 1, 2007

(30) Foreign Application Priority Data

Apr. 28, 2006 (JP) ..... 2006-126865

(51) Int. Cl.
*B41J 2/165* (2006.01)

(52) U.S. Cl. ..... 347/30; 347/29

(58) Field of Classification Search ..... 347/29, 347/30

See application file for complete search history.

(56) References Cited

U.S. PATENT DOCUMENTS 6,631,973 B1 10/2003 Edamura
7,128,390 B2 10/2006 Taniguchi
2005/0041060 A1* 2/2005 Taniguchi ..... 347/30

FOREIGN PATENT DOCUMENTS

JP 2001-063102 3/2001
JP 2005-059554 3/2005

* cited by examiner

*Primary Examiner*—Stephen D Meier
*Assistant Examiner*—Geoffrey Mruk
(74) *Attorney, Agent, or Firm*—Fitzpatrick, Cella, Harper & Scinto

(57) ABSTRACT

To provide a suction recovery method of an ink jet printing apparatus by which ink can be securely filled to an ink flow path and a nozzle while minimizing an amount of ink discharge during a suction recovery to prevent an adverse effect such as invited bubbles. The suction recovery method firstly performs the first suction step for generating a negative pressure for sucking a filter section for separating bubbles from the filter section. Thereafter, a second suction step is performed to generate a negative pressure for sucking an ink in the ink flow path and a large nozzle. Thereafter, a third suction step is performed to suck ink from a small nozzle.

3 Claims, 15 Drawing Sheets

SUCTION RECOVERY METHOD OF INK JET PRINTING APPARATUS AND INK JET PRINTING APPARATUS

BACKGROUND OF THE INVENTION

1. Field of the Invention

The present invention relates to a suction recovery method for maintaining and recovering an ink ejecting performance of an ink jet printing apparatus and an ink jet printing apparatus in which suction recovery is performed by the suction recovery method.

2. Description of the Related Art

In an ink jet printing apparatus in which a minute ejection opening ejects ink droplets for printing, volatile ink components evaporate from the ejection opening of the ink jet head to cause ink to have an increased viscosity, increased ink dye concentration, or fixed ink for example. When an ink flow path of an ink jet head is left for a long time and bubbles are caused in the ink flow path, ink may be prevented from being supplied correctly to cause a significant inconvenience in the printing operation.

In order to avoid the inconvenience as described above, a suction recovery method has been used by which an ejection opening face of an ink jet head is capped and a negative pressure generation means (e.g., tube pump) is used to reduce the pressure in the cap to suck ink from the ejection opening. This method forcedly sucks, from the ejection opening, ink, bubbles, dusts or the like left in the ink flow path that is/are not suitable for a printing operation so that the quality of ink in the ink jet head and a correct printing can be maintained. Then, ink is discharged and new ink is filled in the ink flow path from an ink tank (ink storage section) via a filter.

This suction recovery method may use a tube pump. The suction recovery method using the tube pump is performed by handling a tube by the rotation of a roller. The rotation of a roller causes a negative pressure in the tube. By using such a principle, the tube pump performs the suction recovery operation based on suction conditions (e.g., suction pressure) that can be determined by controlling a motor for rotating the roller during a pump operation (by mainly setting the number of rotations and a rotating speed). However, the suction recovery method by the tube pump has a mechanism to increase the suction pressure while sucking ink, thus failing to set the suction amount and the suction pressure independently.

This suction recovery using the tube pump adjusts the suction amount by setting the number of rotations of the pump driving motor. The time during which the suction is performed is calculated by dividing the number of rotations by the rotating speed. Thus, when the suction recovery is performed by the tube pump, the pump driving motor is set to have an appropriate number of rotations to fill new ink to the ink flow path while sucking ink. When ink is filled to the ink flow path, discharged ink sucked to the cap is discharged from the cap to outside. At the same time, the negative pressure in the cap disappears.

However, when it is desired to secure a predetermined suction amount to set operational conditions, suction by a high-speed rotation as shown by $I_H$ of FIG. 9 causes a steep ascending curve $I_H$ of the suction pressure. This may cause an excessive increase of the suction pressure to cause an increase of the ink flow rate. Since an ink tank has an ink supply capability per a unit time having an upper limit, the ink flow rate exceeding the upper limit may cause a bubble to enter the ink flow path of the ink jet head when ink is supplied.

This phenomenon may be caused when a head 50 having a plurality of ink flow paths for inks of multiple colors as shown in FIG. 10 has significant differences in the flow path length to the ejection opening among the respective ink flow paths for the colors. Flow resistance is generally in proportion to the flow path length. Thus, when the respective nozzles have an identical diameter of an ejection opening, pressure loss as flow resistance will increase with an increase of the flow path length, thus suppressing ink from being sucked. A short flow path on the other hand allows ink to be sucked easily. Specifically, as shown in FIG. 11, even after bubbles are sucked by a short flow path (negative pressure curve: $I_{Lmin}$), a negative pressure is required in the cap to continuously suck ink until $t_{Lmax}$ bubbles are entirely sucked from a long flow path (negative pressure curve: $I_{Lmax}$). In this status, a short flow path has smaller resistance than that of a long flow path and thus a negative pressure curve steeply rises. Thus, the short flow path causes a suction pressure ($P_{Lmin}$) to increase to a level equal to or higher than a suction pressure $P_T$, thus causing an ink supply failure that causes bubbles to be sucked into the flow path.

A method for coping with the case is disclosed in Japanese Patent Laid-Open No. 2001-063102 for example. This method is a method to continuously suck ink to provide a pressure close to a target negative pressure maintained until bubbles are removed, after a pressure reach to negative pressure Pc at which an ink supply failure is not caused. Then the tube pump repeats driving and stopping a plurality of times so that ink suction is continued. FIG. 11 shows then negative pressure curve $I_{Pc}$.

Suction recovery in an ink jet head requires different target negative pressures depending on the size of an ejection opening diameter. A nozzle having a small ejection opening diameter (hereinafter referred to as small nozzle) requires a higher target negative pressure required for the suction recovery than in the case of a nozzle having a large ejection opening diameter (hereinafter referred to as large nozzle). The reason is that a meniscus force in a small nozzle is higher than a meniscus force in a large nozzle and thus ink suction from a nozzle must be performed by such a negative pressure that exceeds the meniscus force of the nozzle.

One of currently-developed ink jet heads has a design in which, in order to realize a printing operation with high-definition and a high speed, a single ink flow path 70 includes large and small nozzles having different ink ejection opening diameters as shown in FIG. 12. In the case of the suction recovery in an ink jet head as described above, the nozzle section 72 having a small ejection opening diameter has a higher meniscus force than that of a nozzle section 71 having a large ejection opening diameter. Thus, the ink suction in this case requires a target negative pressure ($P_N$) that is further higher than a target negative pressure ($P_F$) for sucking ink from the large nozzle. In order to suck ink from these nozzles having different ejection opening diameters by a single capping operation, an approach may be considered in which a suction pressure is steeply increased as shown by a negative pressure curve $I_H$ of FIG. 9 to suck ink from the small nozzle. However, this approach causes the large nozzle to have an ink flow rate exceeding an ink supply capability, causing a risk of an ink supply failure in which bubbles may be invited in the ink flow path. In the case of another approach in which ink is sucked without steeply increasing the suction pressure shown in a negative pressure curve $I_L$, ink suction is continued until a target negative pressure required for filling ink in the small nozzle even after ink is filled in the ink flow path leading toward the large nozzle through which ink is easily sucked, thus increasing waste of ink.

With regards to ink suction from nozzles having different ejection opening diameters by a single capping as described above, a method is disclosed by Japanese Patent Laid-Open No. 2005-059554. This method firstly performs the ink suction with a small suction pressure and a negative pressure suitable for an ink flow path and a large nozzle to fill ink in the large nozzle and the ink flow path to subsequently suck ink from the remaining small nozzle with a high suction pressure instantaneously. Specifically, this method uses two different suction pressures. The negative pressure curve by the suction recovery as described above is shown by $I_{FN}$ in FIG. 9.

However, in the case of a head 90 as shown in FIG. 13 designed for providing further higher definition and speed, the respective nozzles have different ink flow path lengths since the number of nozzles is significantly increased. In addition, ink flow paths for the respective colors have nozzle ejection openings having different diameters.

Thus, in the ink jet head as described above having a structure in which ink flow paths have different lengths and ejection openings have different diameters, each ink flow path requires a different negative pressure required for suction recovery. Thus, it is more difficult for such an ink jet head to provide suction recovery of many nozzle groups by a single capping operation as in the conventional structure. An increased difference in the cross sectional area between nozzles shown in FIG. 12 tends to cause a deteriorated balance between the entire suction amount and suction amount required by the respective ink flow paths. Specifically, such ink suction conditions must be set that apply a high suction pressure to a small nozzle section 92 in FIG. 13 to realize ink suction and that also provide, with regards to ink suction from a large nozzle section 91 from which ink is easily sucked, an ink flow rate that does not exceed an ink supply capability per a unit time. However, it has been difficult to provide such ink suction conditions satisfying both of the former and latter factors.

In order to prevent such a deteriorated suction balance, ink suction is desirably performed so as to minimize pressure loss in nozzle sections by reducing the ink flow rate during ink suction. An increased ink flow rate during an ink suction causes a proportional increase of pressure loss in the respective nozzle sections functioning as resistance. This causes an increased pressure loss in the respective ink flow paths and nozzles to cause further deteriorated suction balance among the respective ink flow paths.

Thus, an ink suction operation is desirably performed with a low-speed rotation so that an ink flow rate is prevented from steeply increasing and the cap has therein a low target negative pressure. As shown in the negative pressure curve $I_L$ of FIG. 14, the low-speed rotation allows the cap interior to have a saturated pressure $P_{sat}$. Thus, this is effective for an ink suction operation that fills, without causing an increased suction pressure, ink to an ink flow path having a high capacity and a large nozzle.

When ink flow paths for the respective colors include therein bubbles, a balance in the suction power among the nozzles for the respective colors further deteriorates. Thus, in order to uniformly transmit a high suction pressure to all small nozzles for the respective colors, it is required, from scratch, for all ink flow paths to be securely filled with ink without bubbles or the like.

However, when an ink flow path including therein bubbles is subjected to a normal suction recovery with an excessively-low target negative pressure, there may be a case where an expanded bubble remains in an ink jet head as shown in FIG. 15 without being moved. Such a bubble left in the ink jet head after ink suction prevents the subsequent ink suction from stably filling ink in the ink flow path. Thus, it is required to securely suck ink prior to the ink filling operation. In order to suck a bubble in ink in an ink flow path, the ink flow path must be applied with a negative pressure so as to provide a suction power exceeding a meniscus force caused at the fluid level. An ink tank and an ink flow path in which ink flows have therebetween a filter. A filter is a member that is designed to trap foreign matter (e.g., dust) included in ink flowing to an ejection opening of a head to prevent the foreign matter from flowing into the ejection opening. Thus, a clearance in the filter is as small as a nozzle ejection opening. A smaller area of a fluid surface causes a higher ink meniscus force, thus causing a higher meniscus force in the filter. Thus, in order to suck a bubble from the filter, a suction negative pressure at some high level is required. In the case of a printing operation having a high ejecting duty requiring a large amount of ink supply in particular, a bubble left in an ink flow path or a filter section may cause a printing failure.

When an ink flow path is subjected to suction recovery with a high negative pressure on the other hand, this causes a proportional increase of an ink flow rate to cause an increased ink flow volume. Since an ink tank has an ink supply capability per a unit time having an upper limit, an ink flow volume exceeding the ink supply capability causes bubbles to be sucked into the ink flow path during ink supply.

Another method for bubbles left in a filter section is disclosed in Japanese Patent Laid-Open No. 2001-063102. This method continuously sucks ink with a target negative pressure that is sufficient for separating such bubbles from a filter section. However, this method suggested by Japanese Patent Laid-Open No. 2001-063102, which uses a control by which sudden stop and sudden rotation of a pump are repeated so as to maintain a negative pressure close to the target negative pressure, causes a significant burden to a driving system including the motor. Thus, a suction recovery unit must be designed to endure such a burden. This causes the suction recovery unit to have a large size, resulting in a higher cost for the manufacture.

SUMMARY OF THE INVENTION

It is an objective of the present invention to provide a suction recovery method of an ink jet printing apparatus by which ink can be securely filled in an ink flow path and a nozzle without causing an adverse effect such as unintended bubbles. It is another objective of the present invention to provide a suction recovery method of an ink jet printing apparatus by which an amount of ink discharge during suction recovery can be minimized.

In the first aspect of the present invention, there is provided a suction recovery method in an ink jet printing apparatus, in which ink is supplied from an ink storage section via an ink flow path to a printing head; the ink storage section and the printing head have therebetween a filter; and the printing head has a plurality of nozzles having different ejection opening diameters, capping an ejection opening face of the printing head with a cap to cause a negative pressure in the cap to suck ink in the printing head, said method comprising: a first suction step for sucking ink with a first target negative pressure; a second suction step for sucking ink, after said first suction step, with a second target negative pressure having a negative pressure lower than the first target negative pressure; and a third suction step for sucking ink, after said second suction step, with a third target negative pressure having a negative pressure higher than the first target negative pressure.

In the second aspect of the present invention, there is provided an ink jet printing apparatus in which ink is supplied from an ink storage section via an ink flow path to a printing head which has a plurality of nozzles having different ejection opening diameters, comprising: a cap for covering the printing head; a tube pump for generating a negative pressure in the cap; a motor for driving the tube pump; and a control means for controlling driving of the motor, wherein said control means performs a control to sequentially execute a first recovery operation for driving said motor at a first speed, a second recovery operation for driving said motor with a second speed lower than the first speed, and a third recovery operation for driving said motor at a third speed higher than the first speed.

The structure as described above can provide a suction recovery method of an ink jet printing apparatus by which ink in the respective nozzles can be sucked with an appropriate suction negative pressure while reducing an amount of ink discharge. The above structure also subjects an ink jet head to a suction recovery operation with a single suction recovery sequence, thus reducing the time required for a suction recovery step. The above structure also can reduce an amount of ink discharge. Thus, such an ink jet printing apparatus can be provided that increases the number of media printed by a single ink filling operation and thus realizes a lower running cost.

Further features of the present invention will become apparent from the following description of exemplary embodiments (with reference to the attached drawings).

DESCRIPTION OF THE EMBODIMENTS

Hereinafter, embodiments of the present invention will be described.

Embodiment 1

Figure 1:
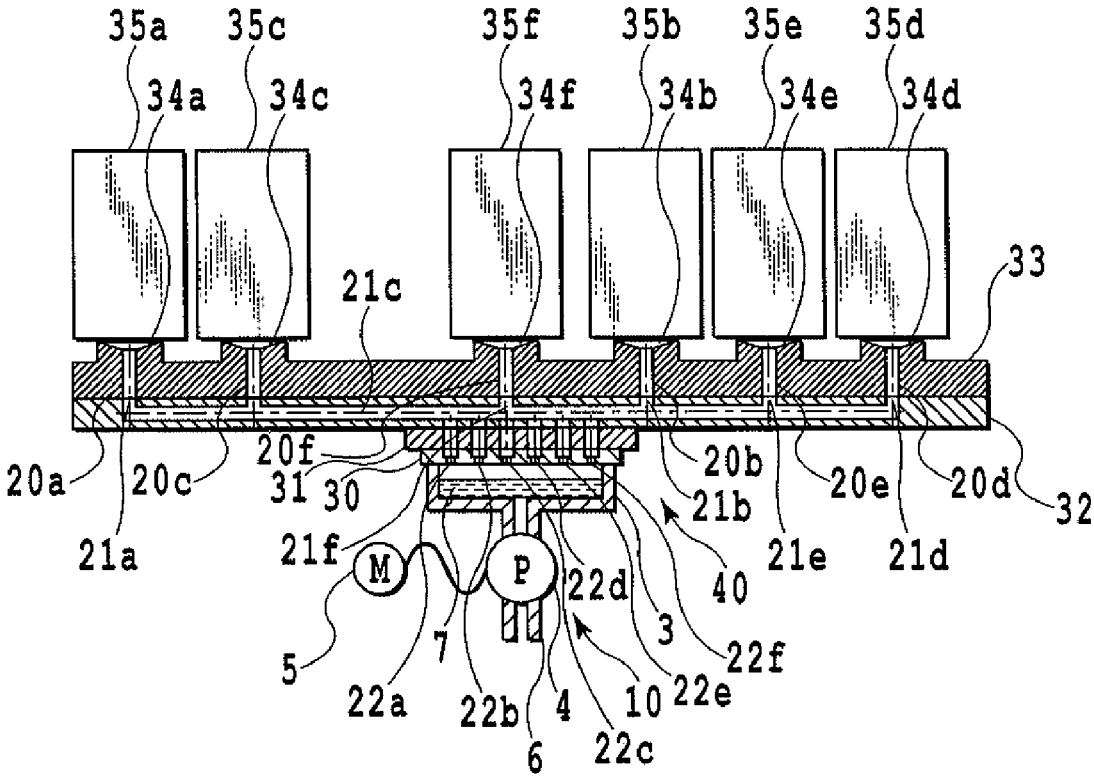
FIG. 1 is a cross-sectional view illustrating an ink jet head, an ink tank, and a suction unit of Embodiment 1.

With reference to FIG. 1 to FIG. 7, structures of an ink jet head and a suction recovery unit of Embodiment 1 based on the present invention will be described. FIG. 1 illustrates an ink jet head 40, ink tanks 35 that are an ink storage section communicating with an ink jet head 40 via ink flow paths 20 and 21, and a suction recovery unit 10 attached to the ink jet head 40. The ink jet head 40 is composed of: a tank holder 33; a flow path plate 32 welded to the tank holder 33; a heat sink 31 attached to the flow path plate 32; and an ejecting chip 30 attached to the heat sink 31. The ejecting chip 30 includes nozzles 22*a* to 22*f* for ejecting ink toward a printing medium (not shown).

Figure 2:
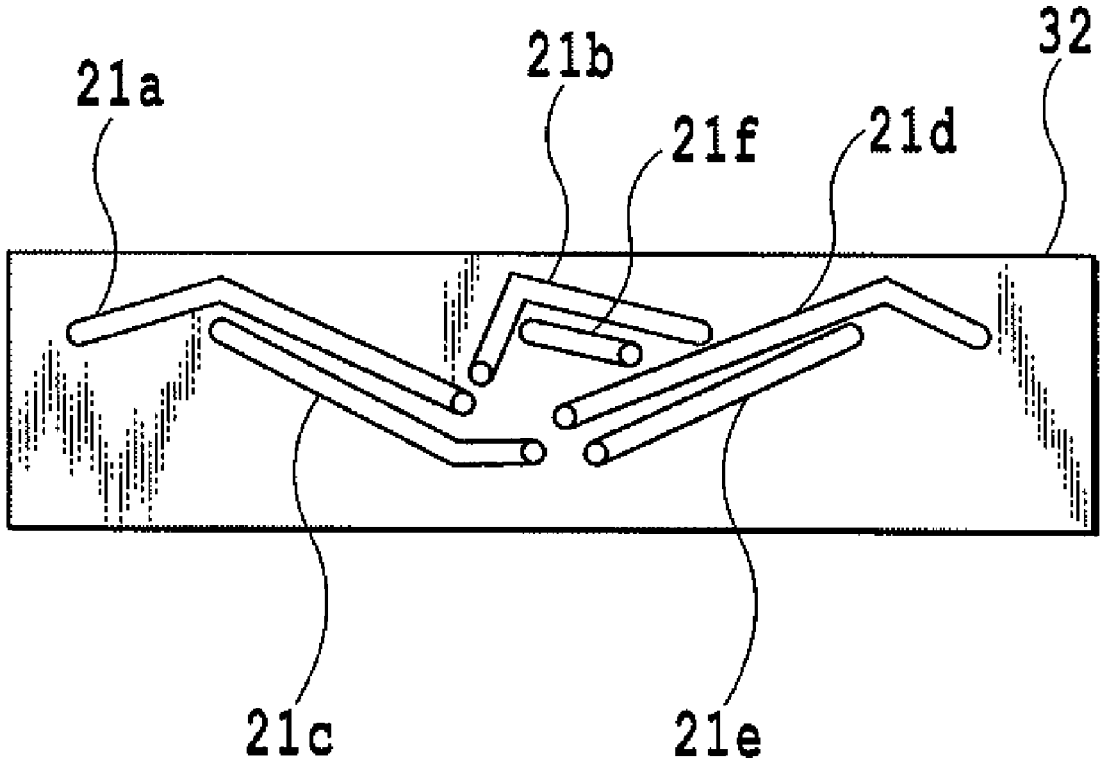
FIG. 2 is a top view illustrating an ink flow path formed in a flow path plate in the ink jet head of FIG. 1.

The ink jet head 40 includes therein ink flow paths 21*a* to 21*f* for conveying ink from the respective ink tanks 35*a* to 35*f* for the respective colors to the respective nozzles 22*a* to 22*f*. FIG. 2 is a cross-sectional view illustrating the ink flow path 21 formed in the flow path plate 32 seen from the above. As shown in FIG. 2, the ink flow paths 21 have different lengths.

The tank holder 33 includes therein ink flow paths 20*a* to 20*f* that communicate with ink flow paths 21*a* to 21*f*, respectively. The ink flow paths 20*a* to 20*f* communicate, at the upstream thereof, with the respective ink tanks 35*a* to 35*f* that have communicating surfaces attached with filters 34*a* to 34*f*, respectively. These filters have a function to filter out dust in ink for example. The respective ink tanks 35*a* to 35*f* are filled with ink.

Figure 3:
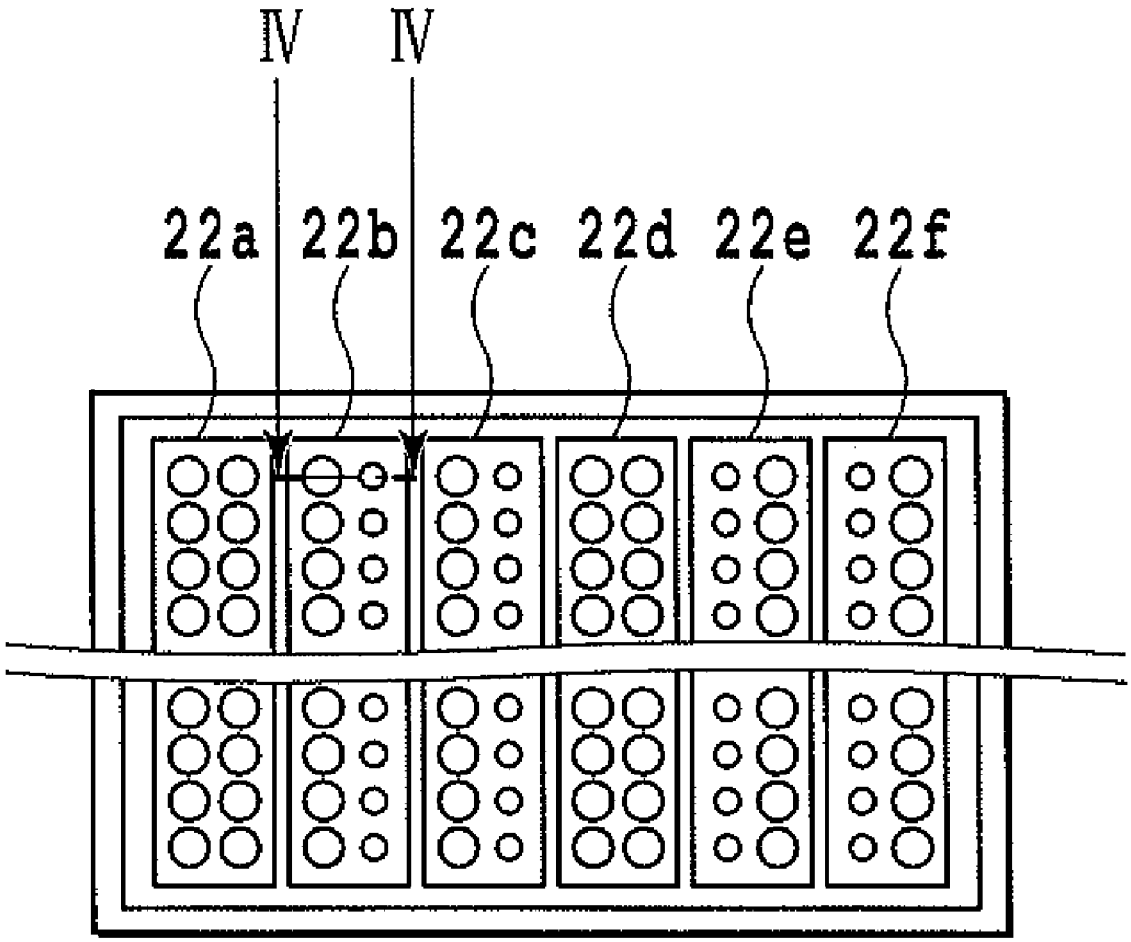
FIG. 3 is a top view illustrating a nozzle array in the ink jet head of FIG. 1.
Figure 4:
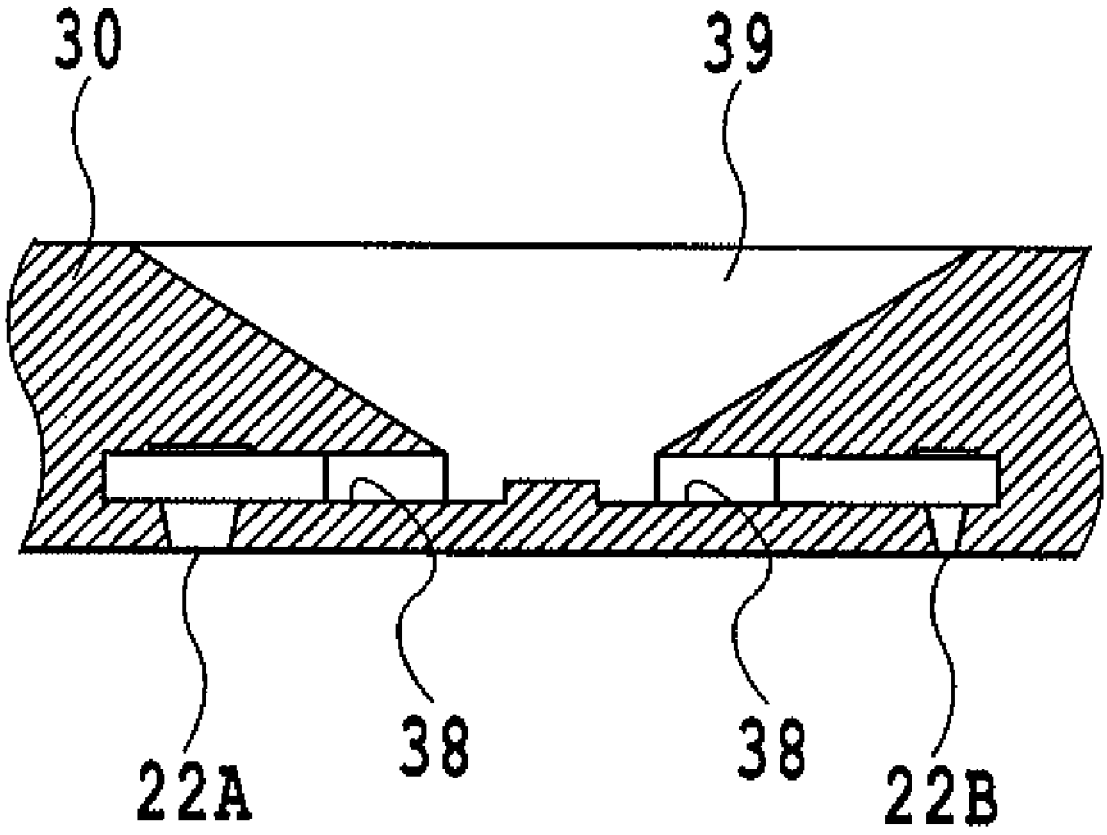
FIG. 4 is a cross-sectional view illustrating an ejecting chip, a common liquid room formed in the ejecting chip, an ink supply pathway, and a nozzle in the ink jet head of FIG. 1.

FIG. 4 is a cross-sectional view illustrating the ejecting chip 30 taken along a line IV-IV in FIG. 3. The ejecting chip 30 includes therein a common liquid room 39 communicating with an ink flow path 21 and also includes ink supply pathways 38 communicating with the common liquid room 39. The ink supply pathway 38 communicates with the nozzle 22. In FIG. 4, the ejecting chip 30 includes nozzles 22A and 22B having different diameters. The nozzle 22A has larger diameter, and the nozzle 22B has smaller diameter.

In Embodiment 1, each of nozzle groups 22*a* to 22*f* is arranged to include 256 nozzles within a width of 0.43 inches (about 11 mm). FIG. 3 is a top view partially showing the ejecting chip 30 including nozzles 22*a* to 22*f*. Each of the nozzles 22*a* and 22*d* includes two nozzle arrays having an identical ejection opening diameter of about 16.4 μm (for 5 pl). Nozzles 30*b*, 30*c*, 30*e*, and 30*f* include nozzle arrays having different ejection opening diameters of about 16.4 μm and about 9.2 μm (for 1 pl).

The characters "a" to "f" added herein to the reference numerals represent the respective colors of: "a" representing black (BK), "b" representing cyan (C), "c" representing light cyan (LC), "d" representing yellow (Y), "e" representing light magenta (LM), and "f" representing magenta (M). All of these colors use dye ink. The total capacity of the ink flow paths 20 and 21 is 0.0776 cc for BK, 0.0558 cc for C, 0.0683 cc for LC, 0.0718 cc for Y, 0.0598 cc for LM, and 0.0403 cc for M. The filters 34*a* to 34*f* are made of SUS material having an outer diameter ϕ of about 3 mm, a structure having three layers having hole diameters of 8 μm/2 μm/8 μm, and a thickness of 0.27 mm and the outer periphery is welded to a tank holder by ultrasonic welding. When the maximum ink flow volume during a printing operation is assumed as 2.9 g/min, pressure loss caused by provision of this filter is 0.017 atm (178 mmAq).

Next, the suction recovery unit 10 will be described. The suction recovery unit 10 is composed of a cap member 3, a tube pump 4 for generating a negative pressure in the cap member 3, and a discharge tube 6 for discharging ink sucked by a negative pressure to the exterior of the ink jet head 40. The cap member 3 covers, when a suction operation (which will be described later) is performed, an ejection opening face of the ink jet head 40 by capping. The operation of the tube pump 4 is performed by driving the recovery motor 5. The suction recovery unit 10 has a control means for controlling the driving of the recovery motor 5.

How the tube pump 4 generates a negative pressure in the cap member 3 will be described with reference to FIG. 5. The tube pump 4 has a tube 23 and a roller 24. The cap member 3 includes a porous member 7 in order to make uniform a suction pressure generated at the nozzle 22 of the ink jet head 40 over the entire suction face of the cap member 3. A negative pressure is generated by firstly driving the recovery motor 5 to rotate and move the roller 24 in a discharge direction (i.e., a direction opposite to the direction having the cap). As a result, the tube 23 in the tube pump 4 is squeezed by the roller 24. The squeezed tube 23 causes air and ink to be forcedly discharged to the discharge tube 6 connected to a pump outlet. Then, the squeezed tube 23 is restored. The restoring force of the squeezed tube 23 causes a negative pressure in the cap member 3. Then, when the roller 24 is continuously rotated in the discharge direction, the capacity occupied by a restored part further increases. Thus, the negative pressure increases in accordance with the rotation amount of the roller 24.

This suction operation is performed by rotating, in the discharge direction, the recovery motor 5 for applying a driving force to the tube pump 4 as a suction means with a predetermined rotating speed and a predetermined pulse number. In Embodiment 1, a specified pulse number to the recovery motor 5 (i.e., the number of rotations N of the motor) corresponds to the number of slits of a motor encoder and a rotating speed w corresponds to the number of slits per one second (slit/s). By setting two parameters of the rotating speed of the recovery motor 5 and the suction time (=the number of rotations/rotating speed) as described above, suction conditions of the tube pump 4 are determined. When these suction conditions are set, the recovery motor 5 controlled by the control means drives, based on the set suction conditions, the tube pump 4 thereby providing ink suction.

Figure 6:
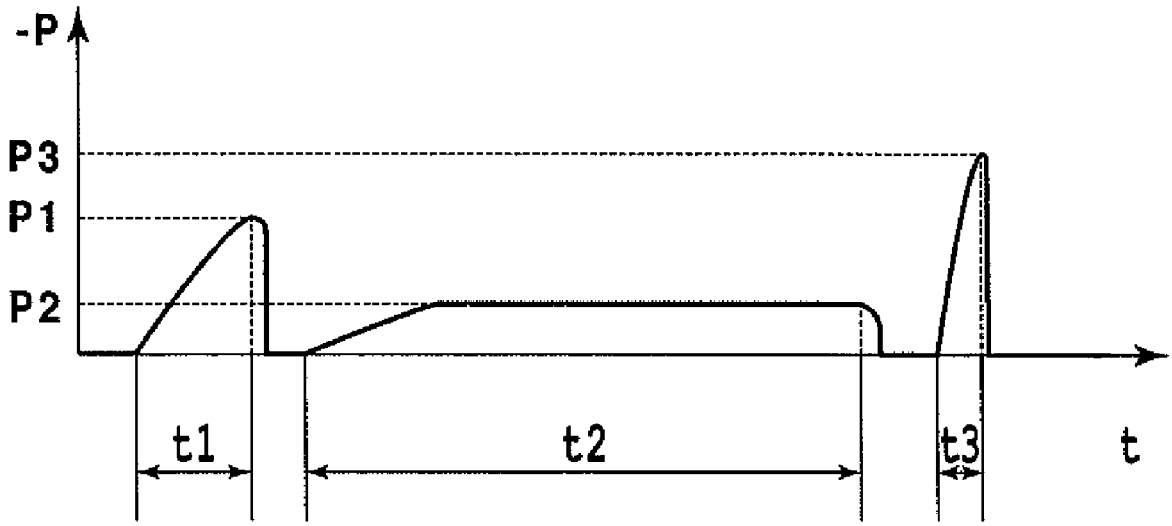
FIG. 6 illustrates a negative pressure curve when the suction unit of Embodiment 1 performs a negative pressure suction.

The suction recovery method in Embodiment 1 will be described with reference to a negative pressure fluctuation curve shown in FIG. 6 during an ink suction operation.

In order to measure the fluctuation of a negative pressure to prepare a negative pressure fluctuation curve, such suction conditions are determined severely for used conditions of the ink jet head 40. In Embodiment 1, in order to increase an ink viscosity, a negative pressure was measured under a dry environment having humidity of 10% and a low temperature of 5 degrees Celcius. Exemplary numeric values shown below are values measured under this environment having such low humidity and low temperature. When the measurement of a negative pressure for removing bubbles while filling ink in an ink flow path by a single suction recovery sequence was performed, the measurement was performed with the severe conditions in which all ink flow paths of a head were emptied.

Embodiment 1 uses a suction recovery method that firstly performs the first suction step for generating the first target negative pressure for separating a bubble from the filter 34. Thereafter, the second and third suction steps are performed to generate the second and the third target negative pressures for sucking ink in the ink flow paths 20 and 21 and the nozzle 22.

Figure 5:
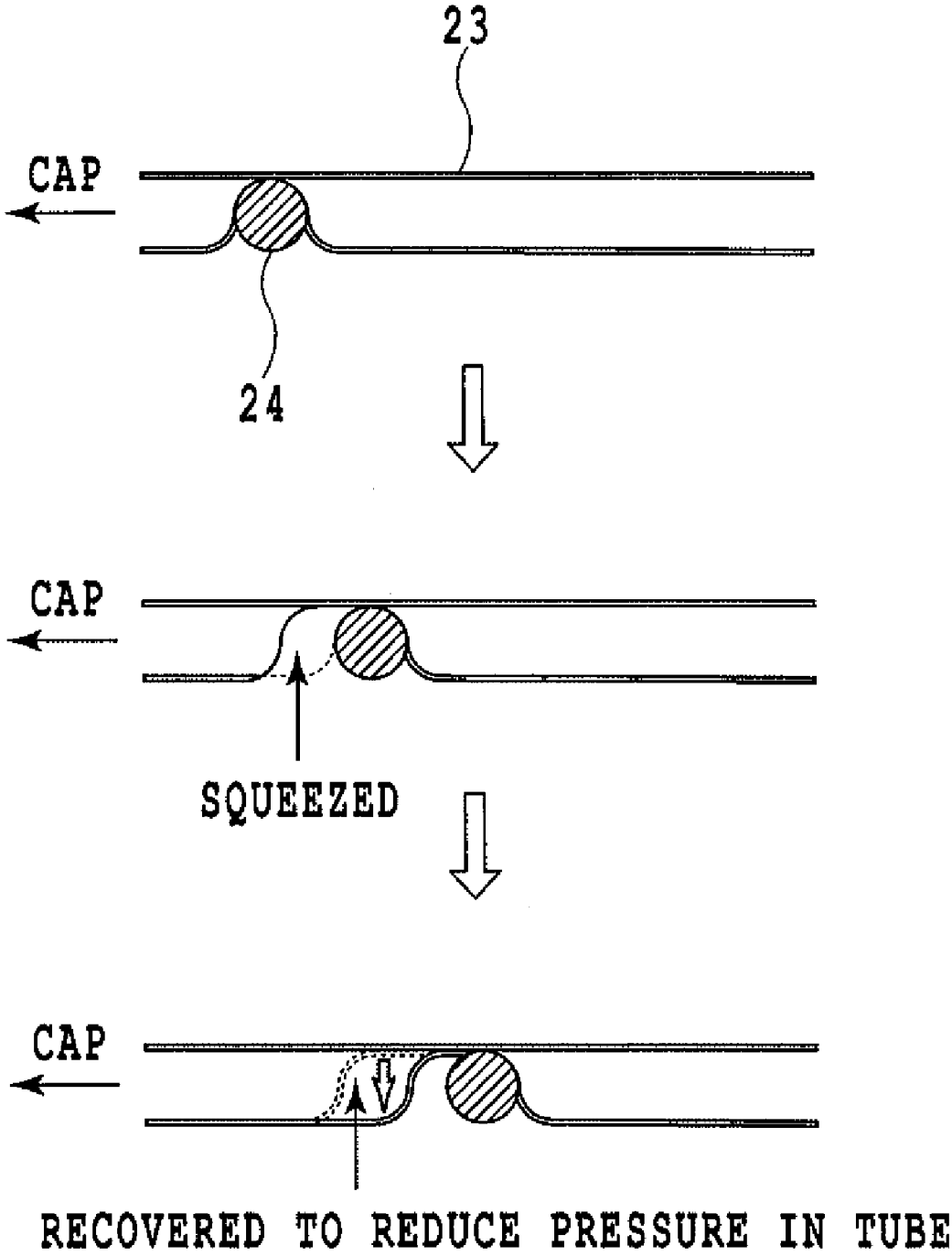
FIG. 5 illustrates the principle of a tube pump in the suction unit of FIG. 1.

First, the roller 24 of the tube pump 4 shown in FIG. 5 is used to press and squeeze the tube 23 to start the first suction step. The first suction step allows the negative pressure in the cap member 3 to reach the first target negative pressure P1 that is a negative pressure for sucking ink in a filter section when a predetermined driving time t1 has passed. The first suction step is performed by the first recovery operation driven by the recovery motor 5 with the first rotating speed. The first suction step of Embodiment 1 is a step for sucking ink from a filter section in order to remove a bubble. When the first suction step is started, the ejection opening face of the ink jet head 40 is applied with a negative pressure and a suction power is caused in the cap member 3. Then, this suction power forcedly sucks, via the ink flow paths 20 and 21 and the nozzle 22, ink from the ink tank 35 communicating with the internal space of the cap member 3. After the driving of the recovery motor 5, an air release valve (not shown) provided in the suction recovery unit 10 is released to discharge discharged ink (sucked ink) stored in the cap from the cap member 3.

As described above, the first target negative pressure P1 only generates a suction power that is required to separate a bubble caused in the vicinity of the filter 34 shown in FIG. 1 from the filter 34. When a bubble is separated from the filter 34, a subsequent suction operation (which will be described later) can smoothly move ink in the ink flow paths 20 and 21. Thus, the subsequent suction operation allows the respective ink flow paths to have a smaller difference in negative pressure for ink suction, thus suppressing a deteriorated suction balance. The first target negative pressure P1 is set to be lower than a suction pressure that may cause an ink flow volume and a speed overwhelming an ink supply capability of the ink flow path from the ink tank 35 and thus may invite a bubble. In Embodiment 1, the predetermined driving time t1 is about 3.7 s and the target negative pressure P1 is about 0.25 atm. After the start of ink suction, the negative pressure in the cap member 3 increases with an increase rate of 0.12 atm/s with the motor rotating speed of 2200 (slit/s) and the number of rotations of 8150 (slit).

Thereafter, the ink jet head 40 performs the second suction step to generate the second target negative pressure P2 for sucking ink from the ink flow paths 20 and 21 and the large nozzle 22A, respectively. When a predetermined time (suction stoppage time) tint1 (about 13 s in Embodiment 1) has passed after the pump driving in the first suction step, the second suction step is started to cause a negative pressure to reach the second target negative pressure P2 when a predetermined driving time t2 has passed. The second suction step is performed by the second recovery operation in which the recovery motor 5 is driven with the second rotating speed. The second target negative pressure P2 may be a negative pressure that can cause a sufficient suction power to flow ink and a bubble from the ink flow paths 20 and 21 and the large nozzle 22A. A bubble removed by this step is a bubble that once existed in the ink flow paths 20 and 21 and the large nozzle 22A and that was sucked from the filter section by the first suction step. The second target negative pressure P2 is set as a negative pressure lower than the first target negative pressure P1. When comparison is made between the first recovery operation and the second recovery operation driven by the recovery motor 5, the second rotating speed of the recovery motor 5 in the second recovery operation is lower than the first rotating speed of the recovery motor 5 in the first recovery operation. In Embodiment 1, the second target negative pressure P2 is a negative pressure sufficient to cause ink to flow from the large nozzle 22A shown in FIG. 4.

The second suction step performed a suction operation with the predetermined driving time t2 of about 7.5 s and the target negative pressure P2 of about 0.17 atm. After the start of ink suction, the negative pressure in the cap member 3 increases with an increase rate of 0.065 atm/s with the motor rotating speed of 1400 (slit/s) and the number of rotations of 10500 (slit). The target negative pressure P2 was reached when about 2.7 s has passed. Thereafter, even if ink suction has continued, the negative pressure increases only a little and caused a substantial saturated pressure. Thus, an ink filling operation can be completed by a nozzle having a large diameter and having a small flow resistance without exceeding an ink supply capability of the ink flow paths from the ink tank 35 and without inviting a bubble. In Embodiment 1, a nozzle having a large diameter means all of the nozzles 22*a* and 22*d* for BK and Y shown in FIG. 3 and a half of nozzles 22*b*, 22*c*, 22*e*, and 22*f* for C, LC, LM, and M other than the nozzles 22*a* and 22*d* (22A of FIG. 4).

Since the second suction step uses a small suction negative pressure, the suction by the second suction step sucks ink, a bubble, dust or the like from the ink flow paths 20 and 21 and the large nozzle 22A is performed for a relatively long time until ink is filled. In the second suction step, a negative pressure increases to the second target negative pressure with an increase rate set to be lower than an increase rate of a negative pressure in the first suction step at which the negative pressure increases to the first target negative pressure. Since the second suction step uses a small ink flow rate, the pressure loss in the large nozzle 22A and the ink flow paths 20 and 21 is small and thus flow resistance is small. Thus, differences in pressure loss among the respective ink flow paths are reduced and thus the respective ink flow paths can have a small difference in the suction negative pressure.

After the motor driving, an air release valve (not shown) is released as in the first suction step. As a result, discharged ink stored in the cap member 3 (sucked ink) is discharged from the cap member 3 via the discharge tube 6.

Next, when a predetermined time (suction stoppage time) tint2 after the completion of the pump driving in the second suction step has passed, the third suction step is started to cause a negative pressure to reach a target negative pressure P3 that is a suction negative pressure for sucking ink in the small nozzle 22B when a predetermined driving time t3 has passed after starting of the third suction step. In Embodiment 1, tint2 is about 13 seconds. The third suction step is performed by the third recovery operation in which the recovery motor 5 is driven with the third rotating speed. The third target negative pressure P3 requires a suction pressure to suck ink in the small nozzle 22B and to fill ink in the small nozzle 22B. In addition, the third target negative pressure P3 is set to be lower than a suction pressure exceeding an ink supply capability of an ink tank, preferably. In Embodiment 1, a predetermined driving time t3 is about 1.8 s and the third target negative pressure is about 0.3 atm. After the start of suction, a negative pressure in the cap increased with an increase rate of about 0.2 atm/s with a motor rotating speed of 3000 (slit/s) and the number of rotations of 5500 (slit/s). When comparison is made between the first recovery operation and the third recovery operation by the recovery motor 5, the third rotating speed in the third recovery operation is higher than the first rotating speed in the first recovery operation. The short driving time t3 of about 1.8 s can reduce the amount of discharged ink from the large nozzle 22A even when a high suction negative pressure is applied thereto. The short driving time t3 of about 1.8 s also can reduce an ink flow volume from the large nozzle to prevent a bubble from being invited due to an ink flow volume exceeding the ink supply capability. A control means of the recovery motor 5 in Embodiment 1 provides a control by which the recovery motor 5 is driven in an order of the first recovery operation, the second recovery operation, and the third recovery operation in order to perform suction recovery in an order of the first suction step, the second suction step, and the third suction step.

At this stage, ink is already filled in the ink flow paths 20 and 21 and the large nozzle 22A. Thus, the ink flow paths include therein no bubble for example. Thus, suction may be performed for a short time because ink only has to be sucked from the small nozzle 22B to fill ink in the small nozzle 22B. The time during which suction by a negative pressure is performed in the third suction step is set to be shorter than a time during which suction by a negative pressure is performed in the first suction step. Since a suction negative pressure in the third suction step is set to be high, the reduced suction time can reduce the amount of ink discharged from the large nozzle 22A during the third suction step. Thus, an amount of wasteful ink discharged can be reduced. In order to set the suction time in the manner as described above, an increase rate of a negative pressure at which a negative pressure increases to the third target negative pressure in the third suction step is set to be higher than an increase rate of a negative pressure at which a negative pressure increases to the first target negative pressure in the first suction step.

The third target negative pressure of the third suction step is set to be higher than the first target negative pressure of the first suction step. The reason is that a meniscus force at small nozzle 22B is higher than a meniscus force at the large nozzle 22A. In order to suck ink, ink must be sucked with a negative pressure exceeding a meniscus force at a fluid surface. Thus, a suction power for sucking ink from the small nozzle 22B is higher than a suction power for sucking ink from the large nozzle 22A.

In Embodiment 1, the rotating speed in the third suction step is set at a fast limit value of the motor. In the ink jet head 40 of Embodiment 1, this rotating speed is required to remove a bubble in the small nozzle 22B. The rotating speed in the third suction step set at a fast limit value of the motor prevents the motor from being operated with a speed exceeding a rotating speed causing the third target negative pressure. Thus, the third suction step is prevented from having a situation where a wrong operation causes an ink flow volume exceeding a limit value to invite a bubble in the ink jet head 40. An excessive increase of an ink flow rate also can be prevented even when an ascending curve of a suction pressure is steeper than expected. This can prevent such an ink supply failure that may invite a bubble in an ink flow path.

In this embodiment, the suction recovery unit 10 sucks ink around the filter 34 to separate a bubble from the filter 34 to subsequently suck ink from the ink flow path and the large nozzle 22A and to fill ink from the ink tank to the ink flow path with suitable suction pressure and suction speed. This can eliminate, during ink filling to the ink flow path, a bubble in the filter section, thus providing smooth suction from the ink flow path and filling of ink thereto. This also can fill ink in the ink flow path without causing a remaining bubble. Thereafter, ink is sucked from the small nozzle 22B with a suction negative pressure higher than that for the ink flow path and the large nozzle 22A.

In order to improve the discharge effect by suction, the second suction step has a negative pressure increase rate lower than that of the first suction step and the third suction step has a negative pressure increase rate higher than that of the first suction step. Thus, the second suction step has the suction time t2 longer than the suction time t1 of the first suction step and the third suction step has the suction time t3 shorter than the suction time t1 of the first suction step. The control means controls the recovery motor 5 so that the second rotating speed has the driving time t2 longer than the driving time t1 with the first rotating speed and the third rotating speed has the driving time t3 shorter than the driving time t1 with the first rotating speed. By doing this, wasteful ink consumption can be suppressed when ink is filled to an ink flow path and a large nozzle. Since the second suction step sucks from an ink flow path and a large nozzle for a long time, bubbles remaining in the ink flow path and the large nozzle can be reduced. Thus, the series of continuous suction operations allows an ink jet head having a plurality of nozzle arrays having ejection openings having different diameters to reduce wasteful ink consumption and to prevent a bubble from being invited thereto when the amount of the ink flow exceeds an ink supply capability from an ink tank to an ink flow path. Thus, more secure suction recovery can be carried out. In this embodiment, the suction recovery unit 10 can perform a suction recovery operation for an ink jet head by a single suction recovery sequence. Thus, wasteful ink consumption can be reduced and the time required for the suction recovery step can be shortened.

Embodiment 2

Figure 7:
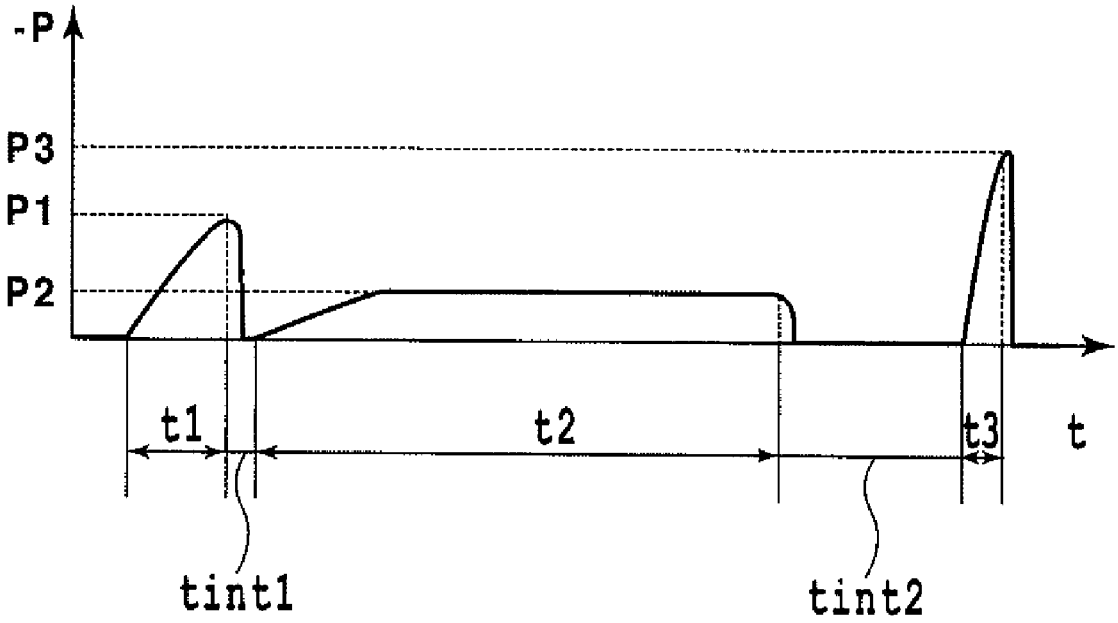
FIG. 7 illustrates a negative pressure curve when a suction unit of Embodiment 2 performs a negative pressure suction.

Embodiment 2 is a suction method that considers, as shown in FIG. 7, a behavior of ink in an ink flow path and influence by disturbance on an ink tank in a time between suction steps in the series of continuous suction operations in Embodiment 1.

In FIG. 7, tint1 represents a suction stoppage time between the first suction step and the second suction step and tint2 represents a suction stoppage time between the second suction step and the third suction step.

With regards to the behavior of ink in an ink flow path after the second suction step, ink is filled in the ink flow path and the large nozzle and thus a meniscus force corresponding to the fluid surface of the large nozzle 22A is caused. Immediately after the first suction step on the other hand, ink is not filled in the large nozzle 22A and thus a meniscus force corresponding to the ink flow paths 20 and 21 is caused. The large nozzle 22A has a diameter smaller than those of the ink flow paths 20 and 21 and thus the meniscus force at the fluid surface after the second suction step is larger than that after the first suction step. Thus, a force required to move ink after the second suction step is higher than that after the first suction step, causing a difficulty in moving ink. Thus, even when ink jet printing apparatus body is subjected to disturbance such as impact or vibration during a suction recovery, the disturbance is suppressed from causing a deformed ink interface or mixed bubbles due to ink movement for example. Thus, influence by the disturbance immediately after the first suction step is severer than immediately after the second suction step. Thus, tint1 causes an unstable status to the disturbance. Consequently, tint1 is desirably set to be short so that ink can be securely filled in an ink flow path without causing mixed bubble for example.

When tint2 is short, a negative pressure in the second suction step may be left in the ink tank 35 during the suction operation in the third suction step. The third suction step applies a high suction negative pressure. Thus, in order to suppress an excessive increase in the negative pressure in the ink tank 35 during the third suction step, no negative pressure is desirably left in the ink tank 35 prior to the third suction step. Thus, in order to eliminate a negative pressure left in the ink tank 35, the time tint2 after the second suction step is desirably set to be long. Thus, this embodiment establishes a relation of tint2≧tint1 to suppress an ink supply failure in which bubbles are invited by a suction recovery operation. Thus, a suction recovery operation can be performed more securely.

Other Embodiments

Figure 8A:
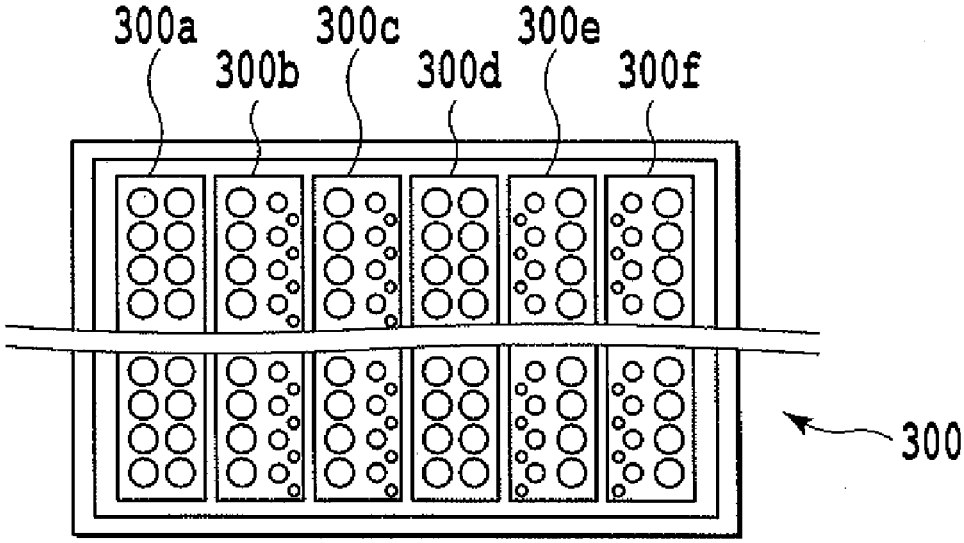
FIG. 8A is a top view illustrating a nozzle array of an ink jet head according to another embodiment.
Figure 8B:
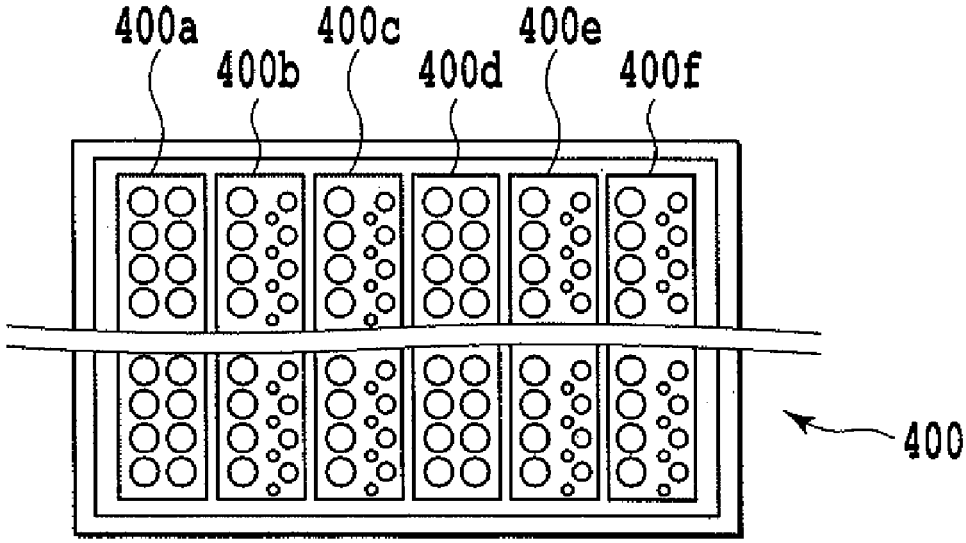
FIG. 8B is a top view illustrating a nozzle array of an ink jet head according to still another embodiment.
Figure 9:
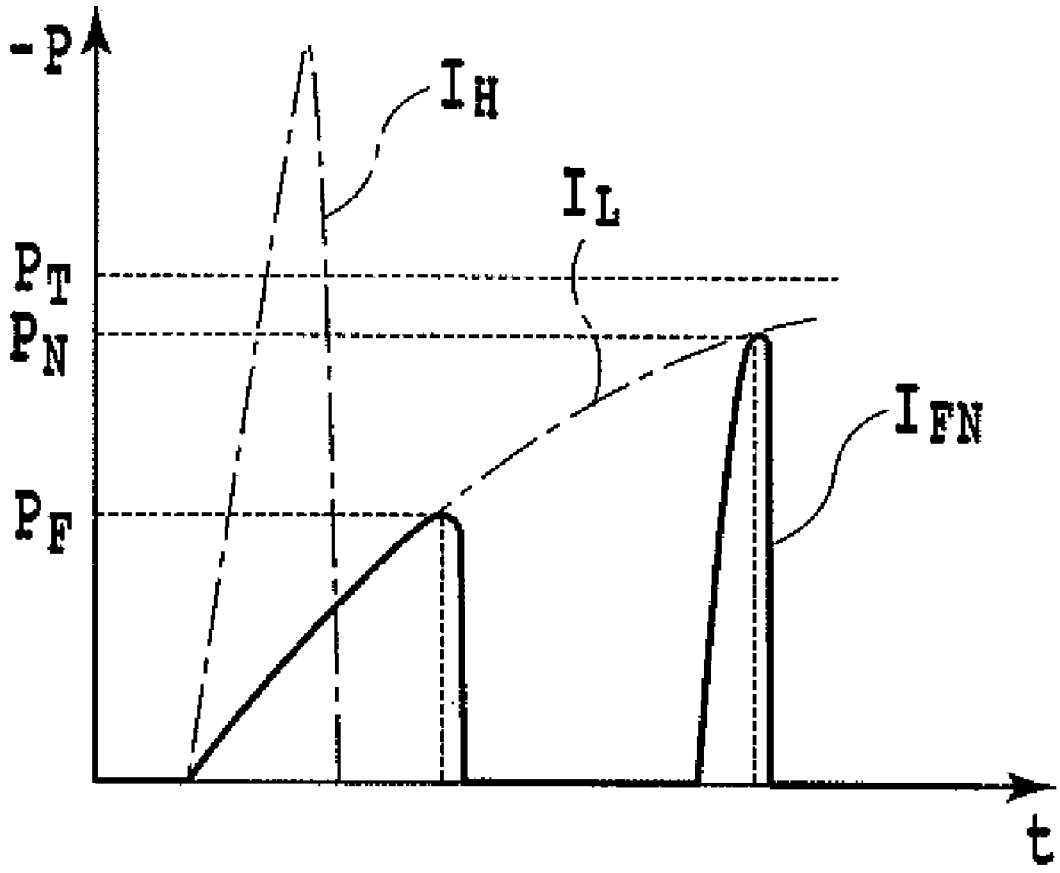
FIG. 9 illustrates a negative pressure curve of a conventional ink jet head of one embodiment.
Figure 10:
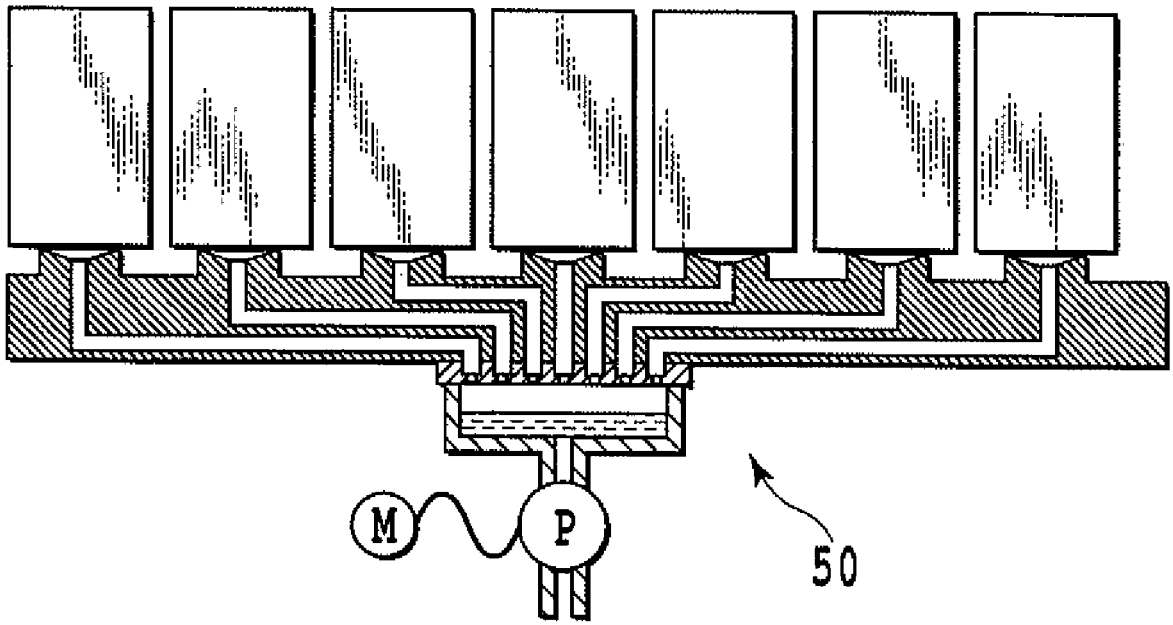
FIG. 10 is a cross-sectional view illustrating a conventional ink jet head that communicates with a plurality of ink tanks and that includes a plurality of nozzles.
Figure 11:
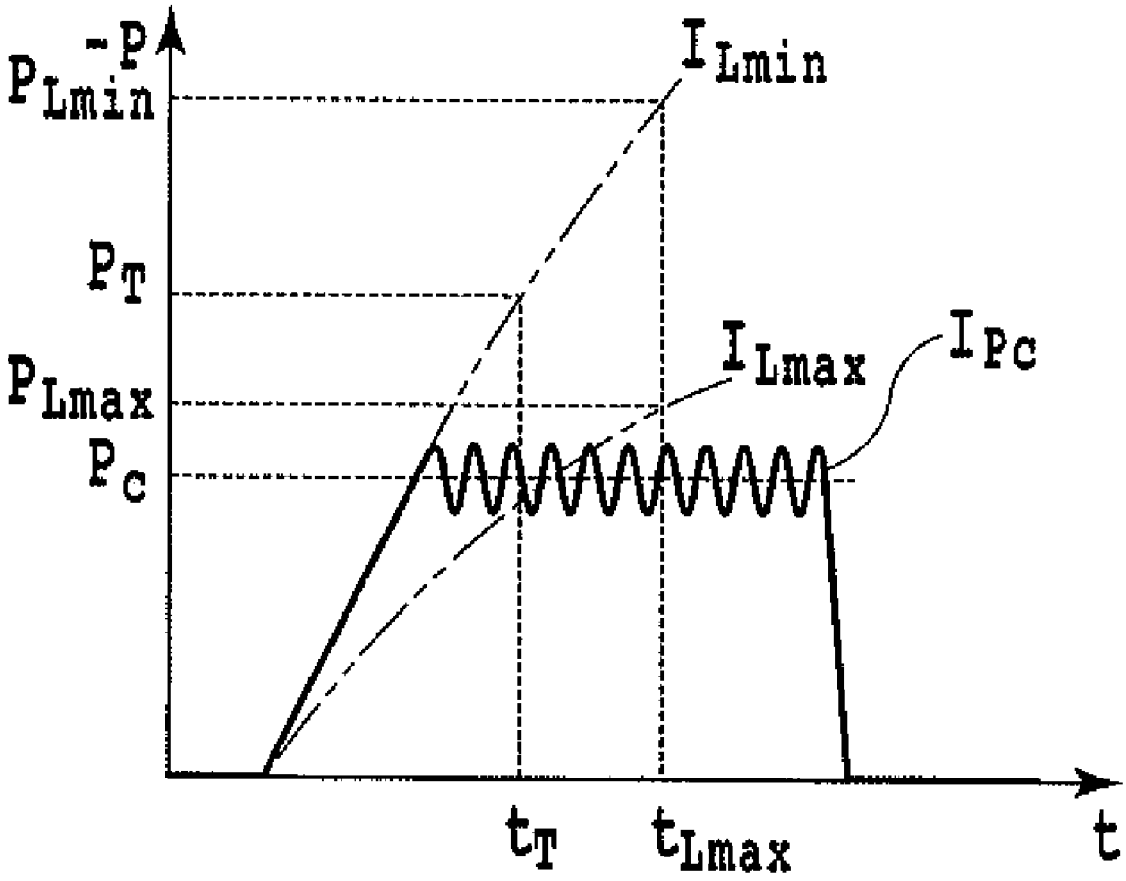
FIG. 11 illustrates a negative pressure curve of an ink jet head of another embodiment.
Figure 12:
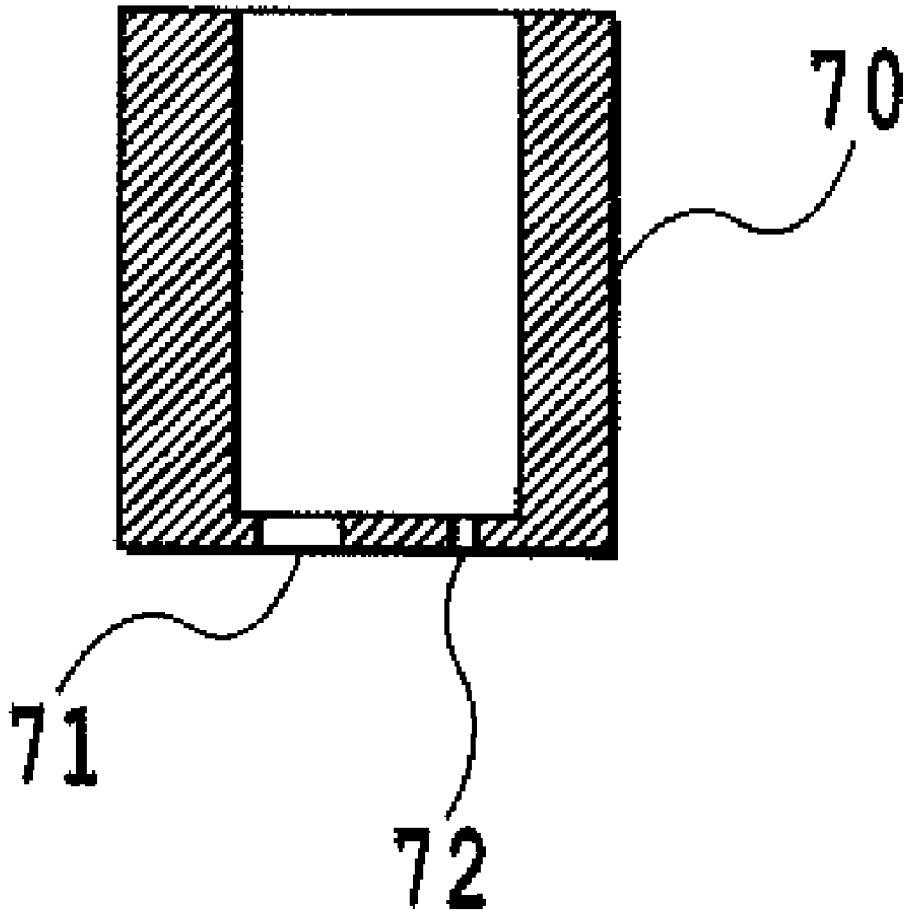
FIG. 12 is a cross-sectional view illustrating a conventional ink flow path having two nozzles having ejection openings having different diameters.
Figure 13:
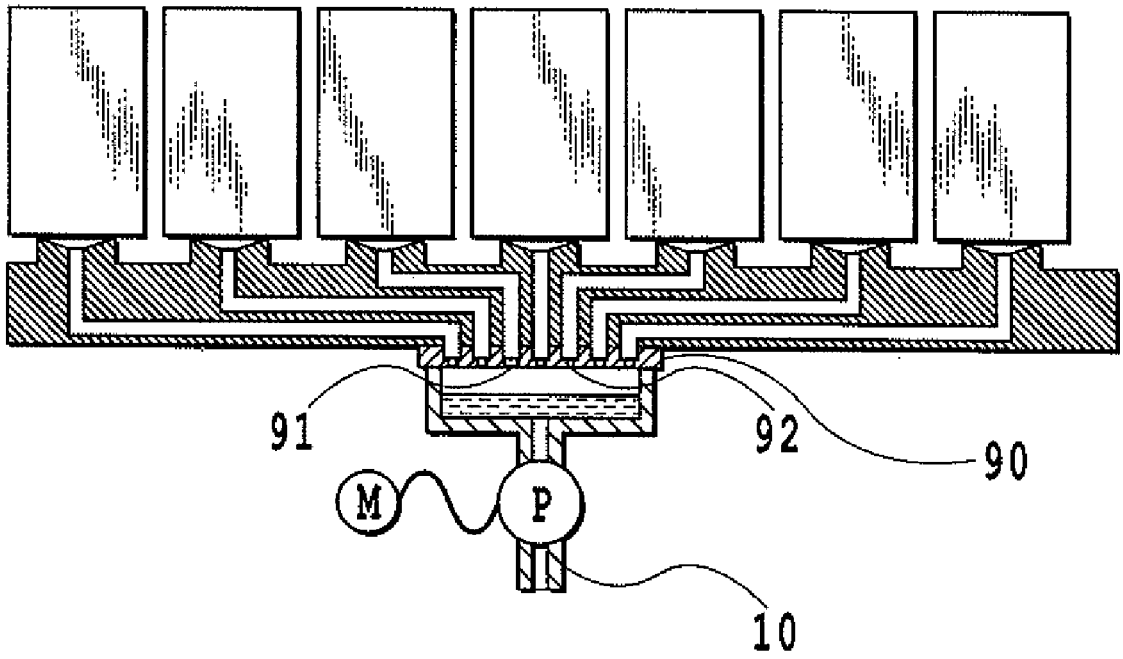
FIG. 13 is a cross-sectional view illustrating a conventional ink jet head that communicates with a plurality of ink tanks and that has a plurality of nozzles having ejection openings having different diameters.
Figure 14:
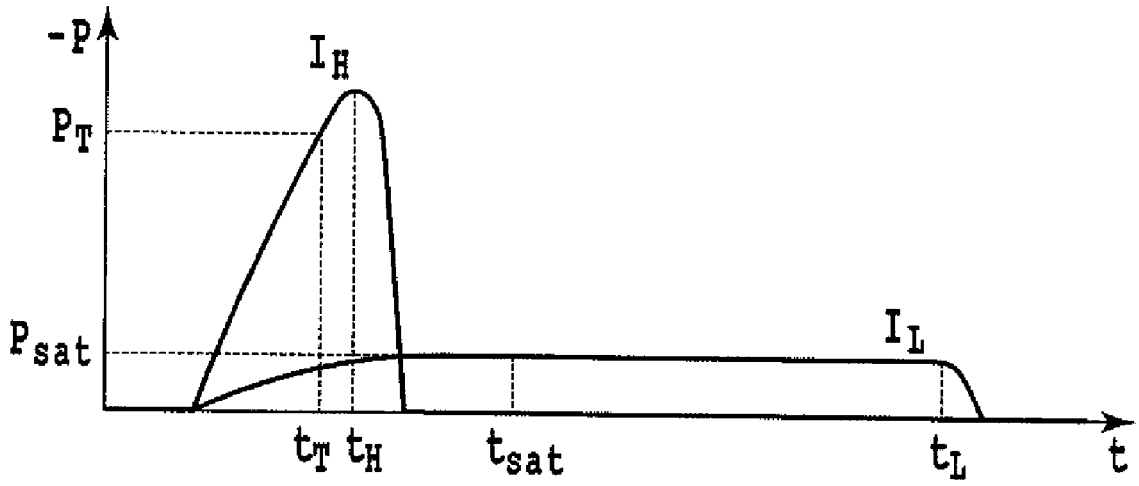
FIG. 14 illustrates a negative pressure curve of a conventional ink jet head in still another embodiment.
Figure 15:
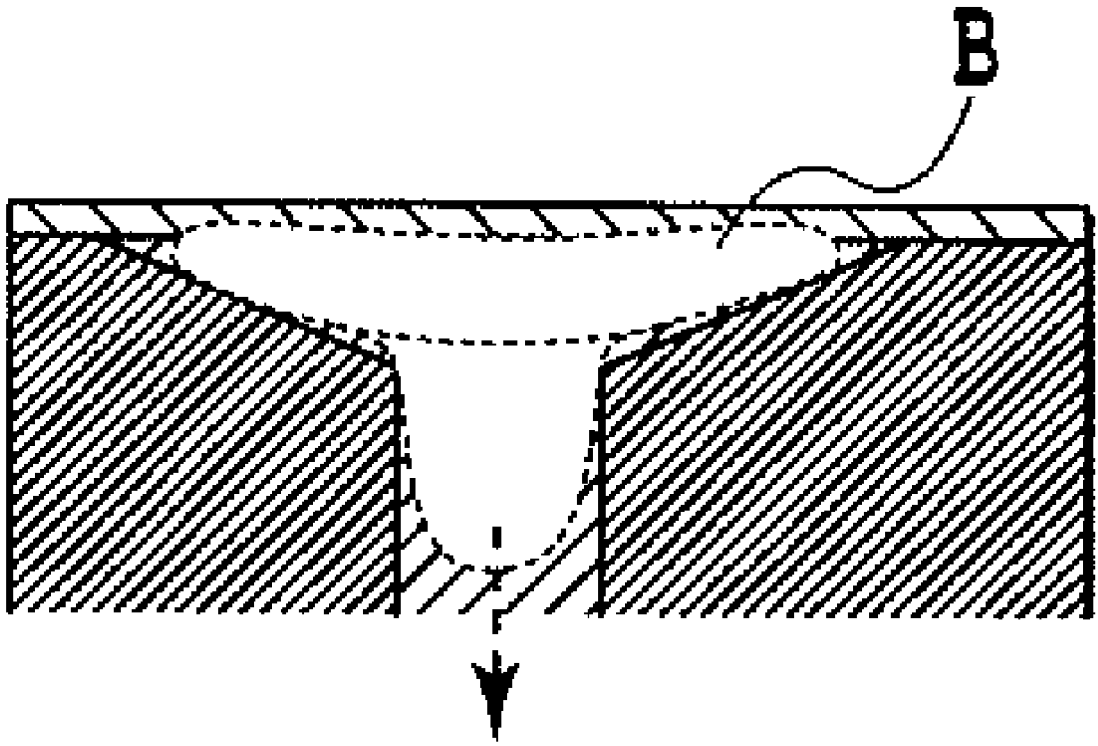
FIG. 15 is a cross-sectional view illustrating an ink flow path of a conventional design at the periphery of a filter section in which a bubble remains at the periphery of the filter section.

Although the above embodiments have used an ink jet head that has ejection openings having two types of large and small diameters, another ink jet head also may be used that has a plurality of ejection openings having three or more different diameters. For example, the ink jet head 300 shown in FIG. 8A or the ink jet head 400 shown in FIG. 8B may be used. The ink jet head is structured so that nozzle arrays 300*c*, 300*e*, 300*f*, 400*b*, 400*c*, 400*e*, and 400*f* have three different ejection opening diameters. The maximum ejection opening diameter of a nozzle is about 16.4 μm (for 5 pl) for example. The second largest ejection opening diameter of a nozzle is about 11.2 μm (for 2 pl). The minimum ejection opening diameter of a nozzle is about 9.2 μm (for 1 pl). In this case, a negative pressure required to separate bubbles from a filter is applied to perform suction in the first suction step. Then, ink is sucked from a nozzle having the maximum ejection opening diameter among nozzles in the printing head with a minimum required negative pressure for sucking ink in the ink flow path for a relatively long time, thereby performing suction in the second suction step. Thereafter, suction in the third suction step is performed with a negative pressure required to suck ink from a nozzle having the smallest ejection opening diameter among nozzles in the printing head for a relatively short time. After the second suction step, ink is already filled in the ink flow path. Thus, ink can be sucked from all nozzles by using the third suction step to apply a negative pressure required to suck ink from a nozzle having the smallest ejection opening diameter. Thus, the suction recovery method according to the present invention also can be used for a printing head that has three or more different ejection opening diameters.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-126865, filed Apr. 28, 2006, which is hereby incorporated by reference herein in its entirety.

What is claimed is:

1. A suction recovery method in an ink jet printing apparatus, in which ink is supplied from an ink storage section via an ink flow path to a printing head, the ink storage section and the printing head have therebetween a filter, and the printing head has a plurality of nozzles having different ejection opening diameters, wherein an ejection opening face of the printing head is capped with a cap to cause a negative pressure in the cap to suck ink in the printing head, said method comprising:

a first suction step for sucking ink with a first target negative pressure;

a second suction step for sucking ink, after said first suction step, with a second target negative pressure having an absolute value lower than an absolute value of the first target negative pressure; and a third suction step for sucking ink, after said second suction step, with a third target negative pressure having an absolute value higher than the absolute value of the first target negative pressure, wherein an absolute value of a negative pressure in said second suction step is increased to the second target negative pressure with an increase rate that is lower than an increase rate at which an absolute value of a negative pressure in said first suction step increases to the first target negative pressure, and an absolute value of a negative pressure in said third suction step is increased to the third target negative pressure with an increase rate that is higher than the increase rate at which the absolute value of the negative pressure in said first suction step increases to the first target negative pressure.

2. The suction recovery method according to claim 1, wherein:

a time during which suction by a negative pressure is performed in said second suction step is longer than a time during which suction by a negative pressure is performed in said first suction step; and a time during which suction by a negative pressure is performed in said third suction step is shorter than a time during which suction by a negative pressure is performed in said first suction step.

3. The suction recovery method according to claim 1, wherein:

a suction stoppage time from the completion of said second suction step to the start of said third suction step is equal to or longer than a suction stoppage time from the completion of said first suction step to the start of said second suction step.

* * * * *